US011082761B2

(12) United States Patent
Bowers et al.

(10) Patent No.: US 11,082,761 B2
(45) Date of Patent: Aug. 3, 2021

(54) VARIABLE LENGTH SOUNDBAR

(71) Applicant: MS ELECTRONICS LLC, Lenexa, KS (US)

(72) Inventors: Adam John Bowers, Overland Park, KS (US); Loren Paul Magruder, Stilwell, KS (US)

(73) Assignee: MS Electronics LLC, Lenexa, KS (US)

( * ) Notice: Subject to any disclaimer, the term of this patent is extended or adjusted under 35 U.S.C. 154(b) by 0 days.

(21) Appl. No.: 17/011,509

(22) Filed: Sep. 3, 2020

(65) Prior Publication Data

US 2021/0076116 A1 Mar. 11, 2021

Related U.S. Application Data

(60) Provisional application No. 62/896,782, filed on Sep. 6, 2019, provisional application No. 63/006,244, filed on Apr. 7, 2020.

(51) Int. Cl.
*H04R 1/02* (2006.01)
*H04R 5/02* (2006.01)

(52) U.S. Cl.
CPC ..... *H04R 1/025* (2013.01); *H04R 1/026* (2013.01); *H04R 5/02* (2013.01); *H04R 2499/15* (2013.01)

(58) Field of Classification Search
CPC ..... H04R 1/025; H04R 1/026
See application file for complete search history.

(56) References Cited

U.S. PATENT DOCUMENTS

2012/0308065 A1* 12/2012 Padalino ..... H04R 5/02 381/335

* cited by examiner

*Primary Examiner* — Andrew L Sniezek
(74) *Attorney, Agent, or Firm* — Hovey Williams LLP

(57) ABSTRACT

A variable length soundbar broadly comprising a number of leveling brackets, an elongated alignment bar, a number of speakers mounting brackets, a number of speakers, and a grille. The leveling brackets include a vertical screw leveler for leveling the elongated alignment bar and hence the speakers. The speaker mounting brackets are configured to be laterally spaced from each other on the elongated alignment bar. The speakers each include a number of drivers configured to output sounds of different frequencies. The grille is configured to at least partially cover the speakers. The grille and the elongated alignment bar are configured to be resized to a desired length.

19 Claims, 8 Drawing Sheets

VARIABLE LENGTH SOUNDBAR

RELATED APPLICATIONS

This application is a regular utility non-provisional application and claims priority benefit of U.S. Provisional Patent Application Ser. No. 62/896,782, entitled "VARIABLE LENGTH SOUNDBAR", filed Sep. 6, 2019 and U.S. Provisional Patent Application Ser. No. 63/006,244, entitled "VARIABLE LENGTH SOUNDBAR", filed Apr. 7, 2020. The above-referenced provisional applications are hereby incorporated by reference in their entireties.

BACKGROUND

Soundbars are often used to provide or supplement television or projector audio output and to provide sound-system alternatives that are easy to set up yet produce comparable or even improved audio quality. Soundbars are typically sold separately from televisions and projector screens and thus are often longer or shorter than widths of televisions and projector screens to which they are paired, resulting in unsightly entertainment setups.

Variable length soundbars partially solve this problem by including optional frame extensions. However, frame extensions at most provide a few discrete lengths and do not accommodate the virtually continuous spectrum of television widths. The frame extensions also limit the speakers to a few discrete speaker spacings and positions, thus limiting acoustic options.

Furthermore, soundbars often are not the correct size for the room in which they are used. This may result in large soundbars that overpower small rooms or entertainment areas and small soundbars that underpower large rooms or entertainment areas. Conversely, variable length soundbars typically include a set number of speakers regardless of their size, which may result in small soundbars that overpower small rooms or entertainment areas and large soundbars that underpower large rooms or entertainment areas.

SUMMARY

Embodiments of the invention solve the above-mentioned problems and other problems and provide a distinct advancement in the art of variable length soundbars. More particularly, the invention provides a variable length soundbar that can have any desired length.

An embodiment of the invention is a variable length soundbar broadly comprising a number of leveling brackets, an elongated alignment bar, a number of speaker mounting brackets, a number of speakers, a grille, and left and right end caps.

The leveling brackets are substantially similar to each other and each includes a number of wall fastener apertures, an alignment bar ledge, a stop screw, and a vertical screw leveler. The leveling brackets are configured to be spaced apart from each other and secured to a wall or other vertical structure to support the variable length soundbar.

The wall fastener apertures receive wall screws therethrough and are staggered relative to each other to provide additional vertical and lateral support. The wall fastener apertures may be positioned on a vertically extending flange below the vertical screw leveler.

The alignment bar ledge is a laterally extending surface configured to support a portion of the alignment bar thereon. The alignment bar ledge may be unobstructed from above so that the alignment bar can be positioned on the alignment bar ledge from directly above the leveling bracket.

The stop screw extends over the alignment bar ledge above the alignment bar to retain the alignment bar on the alignment bar ledge. The stop screw may be at least partially drawn out of the leveling bracket to allow the alignment bar to be positioned on and/or removed from the alignment bar ledge. Alternatively, a pin, clip, latch, or other similar mechanism may be used.

The vertical screw leveler may be or may include a rotatable helical threaded bolt or similar device for raising or lowering the alignment bar relative to the leveling bracket. The vertical screw leveler may also include a slider or similar component configured to engage the alignment bar and be moved vertically by the helical threaded bolt.

The leveling brackets are spaced apart from each other between the speakers or at least between the speaker mounting brackets. If more than three speakers are used, the leveling brackets may be placed adjacent the outermost speakers.

The alignment bar extends beyond the leveling brackets to the outermost speaker mounting brackets. The alignment bar may be resized to a custom length as described in more detail below. The alignment bar may be an elongated flat bar, a rod, a bracket, and may include extended speaker mounting bracket attachment geometry such as a groove, a slot, a ridge, a rail, a track, or any other suitable extended attachment geometry. The extended speaker bracket attachment geometry allows the speaker mounting brackets to be attached to the alignment bar at one of a continuous plurality of points on the alignment bar.

The speaker mounting brackets are substantially similar and each includes an alignment bar recess, an alignment bar fastener aperture, a T-slot, a wire guide, a number of upper magnet recesses, a number of lower magnet recesses, a number of upper grille retention magnets, and a number of lower grille retention magnets. The speaker mounting brackets are configured to be laterally spaced from each other along the alignment bar.

The alignment bar recess may be shaped to correspond to a cross sectional shape of the alignment bar. The alignment bar recess also allows the speaker mounting bracket to be laterally slid along the alignment bar for ease of assembly.

The T-slot is an open-ended groove configured to receive a T-shaped nut and a speaker fastener (described below) therein for anchoring the speaker thereto. The T-slot may be positioned approximately vertically midway to align with a fastener slot of the speaker.

The upper grille retention magnets are positioned in the upper magnet recesses and magnetically attract an upper portion of the grille to retain the grille over the speakers. The upper grille retention magnets may be positioned in recesses in an upper surface of the speaker mounting bracket.

The lower grille retention magnets are positioned in the lower magnet recesses magnetically attract a lower portion of the grille to retain the grille over the speakers. The lower grille retention magnets may be positioned in recesses in a lower surface of the speaker mounting bracket.

The speakers are substantially similar and each includes one or more drivers, a backplate, left and right fasteners, and left and right T-nuts. The speakers may be spaced a desired amount apart from each other.

Each driver may be a low frequency range driver, a mid-frequency range driver, a high frequency range driver, and/or a combination thereof (e.g., a low and mid frequency range driver). The drivers may be arranged in a horizontally symmetric row or any other pattern and are at least partially positioned in a driver chamber of the speaker.

The left and right fasteners are elongated bolts that extend through through-holes in the speaker and may include helical threads for engaging the left and right T-nuts. The left and right fasteners thereby secure the speaker to the speaker mounting bracket.

The left and right T-nuts are flanged nuts having a central aperture with helical threads for engaging the left and right fasteners. To that end, the left and right T-nuts are positioned in the T-slot of the speaker mounting bracket with their central apertures aligned with the through-holes of the speaker.

The grille may be a laterally elongated rigid cover having a front portion, an upper portion, and a lower portion. The front portion conceals the drivers of the speakers. The upper portion extends over the speakers from a top of the front portion and magnetically engages the upper grille retention magnets. The lower portion extends under the speakers from a bottom of the front portion and magnetically engages the lower grille retention magnets. To that end, the grille may be metal or may be a plastic material embedded with ferrous metal for engaging the upper and lower grille retention magnets. The grille may have any desired length (e.g., cut-to-length) corresponding to the desired length of the variable length soundbar.

The left and right end caps bookend the grille to provide a finished appearance. To that end, the left and right end caps may be friction-fit onto left and right ends of the grille or attached to the grille or outer speakers via fasteners.

In use, the speakers are positioned in the speaker mounting brackets such that each speaker is received in two speaker mounting brackets. For example, one of the speakers is positioned in two of the speaker mounting brackets. The left and right T-nuts are positioned in the T-slot. The left and right fasteners are rotated in the through-holes of the speaker so as to draw the left and right T-nuts and hence the speaker against the speaker mounting bracket.

The alignment bar may then be resized to a desired length. For example, the alignment bar may be cut to a length equal to a width of a television to which the variable length soundbar is to be paired. Alternatively, the alignment bar may be telescoping. The grille may be cut to an equivalent length.

The speaker mounting brackets may then be positioned on the alignment bar with the alignment bar being received in the alignment bar recess of each speaker mounting bracket. Fasteners may then be inserted through the alignment bar fastener apertures of the speaker mounting brackets into the extended speaker bracket attachment geometry of the alignment bar.

Speaker mounting brackets paired together are spaced from each other so they are flush with left and right sides of the speaker. Speaker mounting brackets of adjacent pairs are also spaced from each other so that the corresponding speakers are spaced from each other a desired distance.

The alignment bar is then positioned on the alignment bar ledge on the vertical screw leveler of each of the leveling brackets. The leveling brackets are spaced from each other to fit between adjacent speakers. The stop screw may then be drawn into the alignment bar ledge over the alignment bar to prevent the alignment bar from lifting off the alignment bar ledge.

The leveling brackets are then secured to a wall or other vertical structure via fasteners inserted through the wall fastener apertures of the leveling brackets. The leveling brackets should be nominally level with each other.

The grille is then placed over the speakers such that the speakers are concealed. To that end, the upper grille retention magnets secure the upper portion of the grille and the lower grille retention magnets secure the lower portion of the grille. The grille may be truncated or reduced in length so that the grille is flush with outer sides of outer speaker mounting brackets and/or outer speakers.

The alignment bar and hence the speakers are then fully leveled via the vertical screw leveler of each leveling bracket if necessary. To that point, the variable length soundbar may be snug against the TV or projector screen or spaced below the TV or projector screen as desired. This may require removing the grille to adjust the vertical screw leveler (of one or both of the leveling brackets) then installing the grille to check levelness.

The left and right end caps are then secured onto ends of the grille. This results in the variable length soundbar appearing to be a single solid unit.

The variable length soundbar provides several advantages. For example, the speakers can be spaced from each other as desired with minimal tooling and no electronics knowledge. This allows for fine-tuning acoustics for any room or entertainment area. The variable length soundbar can be any desired length instead of one of a few pre-set lengths. This allows the variable length soundbar to match widths of virtually any television or entertainment device. The variable length soundbar may use virtually any ratio of speakers to soundbar length. For example, one speaker may be used every 18 inches. One speaker may be used for less than 18 inches for more output, while one speaker may be used for more than 18 inches for less output. The grille allows the variable length soundbar to appear seamless and uniform while maintaining a custom length.

BRIEF DESCRIPTION OF THE DRAWING FIGURES

Embodiments of the present invention are described in detail below with reference to the attached drawing figures, wherein.

DETAILED DESCRIPTION OF THE EMBODIMENTS

Figure 1:
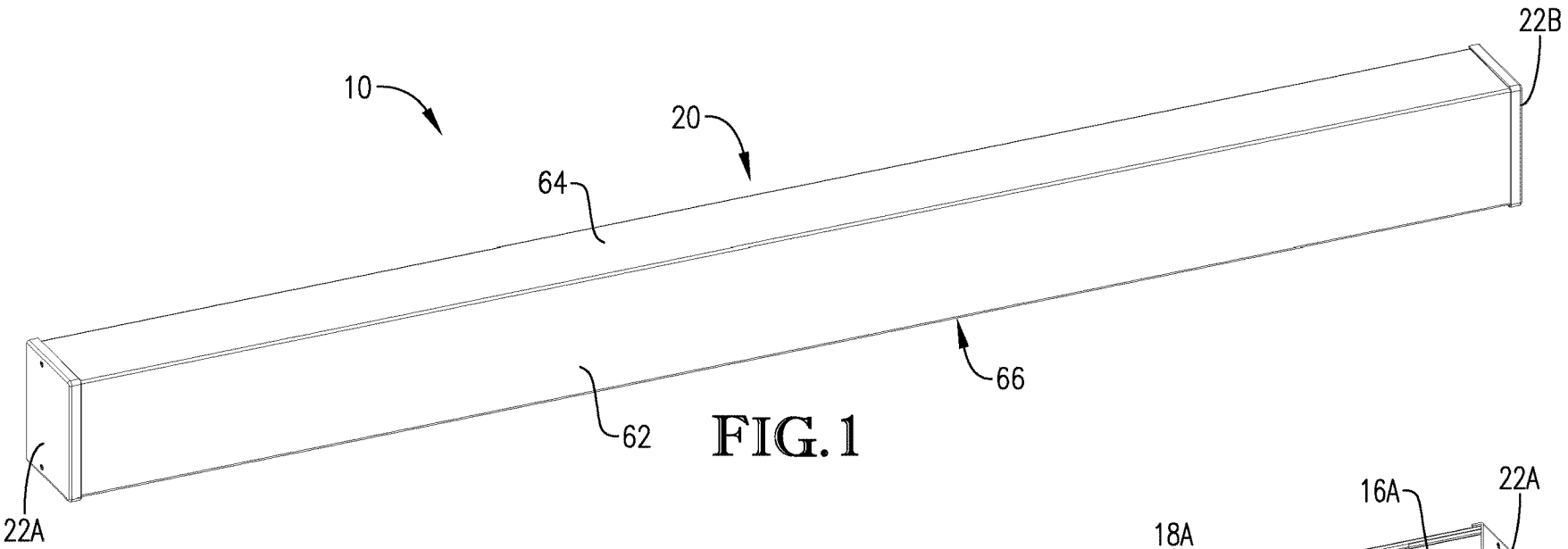
FIG. 1 is a front perspective view of a variable length soundbar constructed in accordance with an embodiment of the invention.
Figure 2:
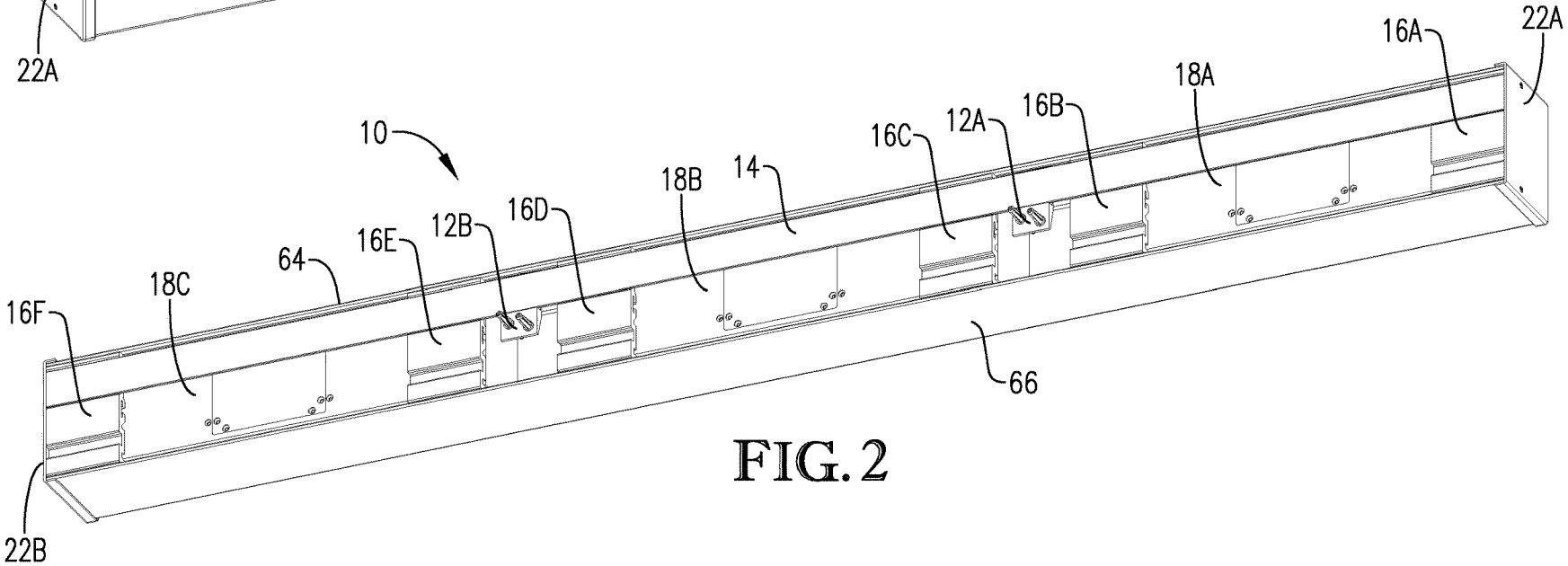
FIG. 2 is a rear perspective view of the variable length soundbar of FIG. 1.

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning to the drawing figures, a variable length soundbar 10 that can be sized to any desired length is illustrated. The variable length soundbar 10 broadly comprises a plurality of leveling brackets 12A,B, an elongated alignment bar 14, a plurality of speaker mounting brackets 16A-F, a plurality of speakers 18A-C, a grille 20, and left and right end caps 22A,B.

Figure 9:
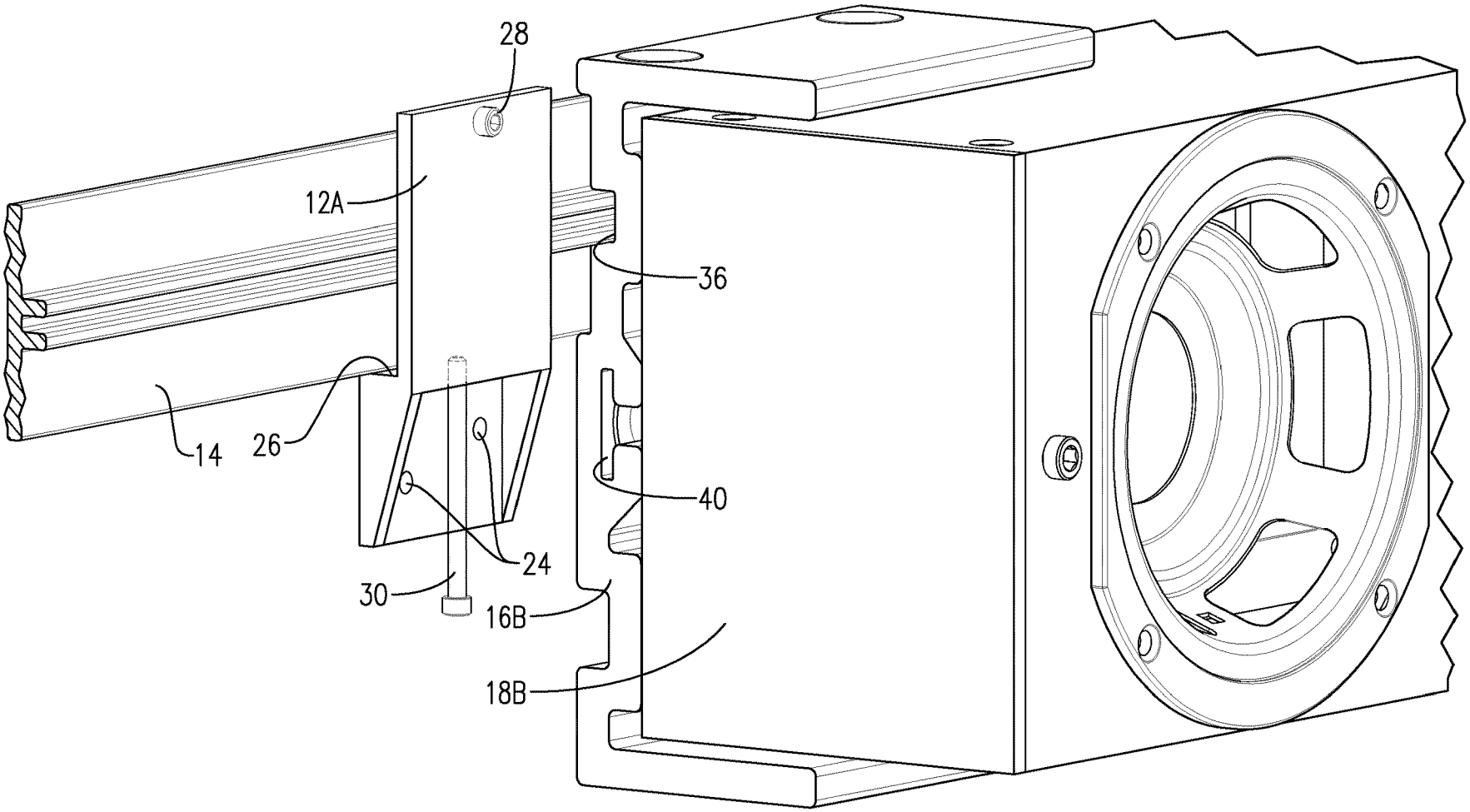
FIG. 9 is a front perspective view of certain components of the variable length soundbar of FIG. 1.

The leveling brackets 12A,B are substantially similar so only leveling bracket 12A will be described in detail. The leveling bracket 12A includes a plurality of wall fastener apertures 24, an alignment bar ledge 26, a stop screw 28, and a vertical screw leveler 30, as best shown in FIG. 9.

The wall fastener apertures 24 receive wall screws therethrough and may be staggered relative to each other to provide additional vertical and lateral support. The wall fastener apertures 24 may be positioned on a vertically extending flange below the vertical screw leveler 30.

The alignment bar ledge 26 may be a laterally extending surface configured to support a portion of the alignment bar 14 thereon at least during initial assembly. The alignment bar ledge 26 may be unobstructed from above so that the alignment bar 14 can be positioned on the alignment bar ledge 26 from directly above the leveling bracket 12A.

The stop screw 28 extends over the alignment bar ledge 26 above the alignment bar 14 to retain the alignment bar 14 on the alignment bar ledge 26. The stop screw 28 may be at least partially drawn out of the leveling bracket 12A to allow the alignment bar 14 to be positioned on and/or removed from the alignment bar ledge 26. Alternatively, a pin, clip, latch, or other similar mechanism may be used.

The vertical screw leveler 30 may be or may include a rotatable helical threaded bolt or similar device for raising or lowering the alignment bar 14 relative to the leveling bracket 12A. The vertical screw leveler 30 may also include a slider or similar component configured to engage the alignment bar 14 and be moved vertically by the helical threaded bolt.

The leveling brackets 12A,B may be spaced apart from each other between the speakers 18A-C or at least between the speaker mounting brackets 16A-F. If more than three speakers are used, the leveling brackets 12A,B may be placed adjacent the outermost speakers.

The alignment bar 14 extends beyond the leveling brackets 12A,B to the outermost speaker mounting brackets 12A-F and may include extended speaker mounting bracket geometry 36. The extended speaker mounting bracket geometry 36 may be a groove, a slot, a ridge, a rail, a track, or any other suitable extended attachment geometry. The extended speaker bracket attachment geometry 36 allows the speaker mounting brackets 16A-F to be attached to the alignment bar 14 at one of a continuous plurality of points on the alignment bar 14. The alignment bar 14 may be resized to a custom length as described in more detail below. The alignment bar 14 may be an elongated flat bar, a rod, a bracket, and may have fastener holes, notches, or the like.

Figure 6:
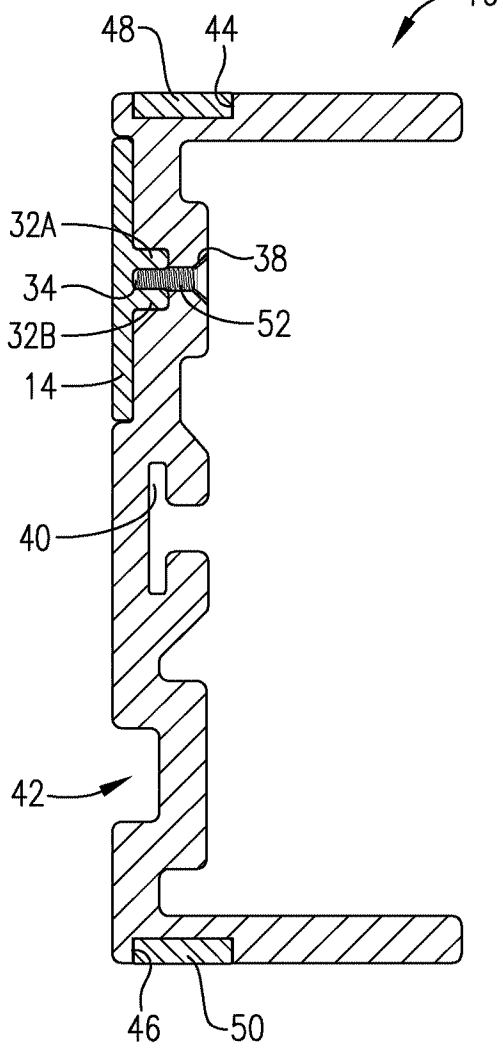
FIG. 6 is a side cutaway elevation view of certain components of the variable length soundbar of FIG. 1.
Figure 5:
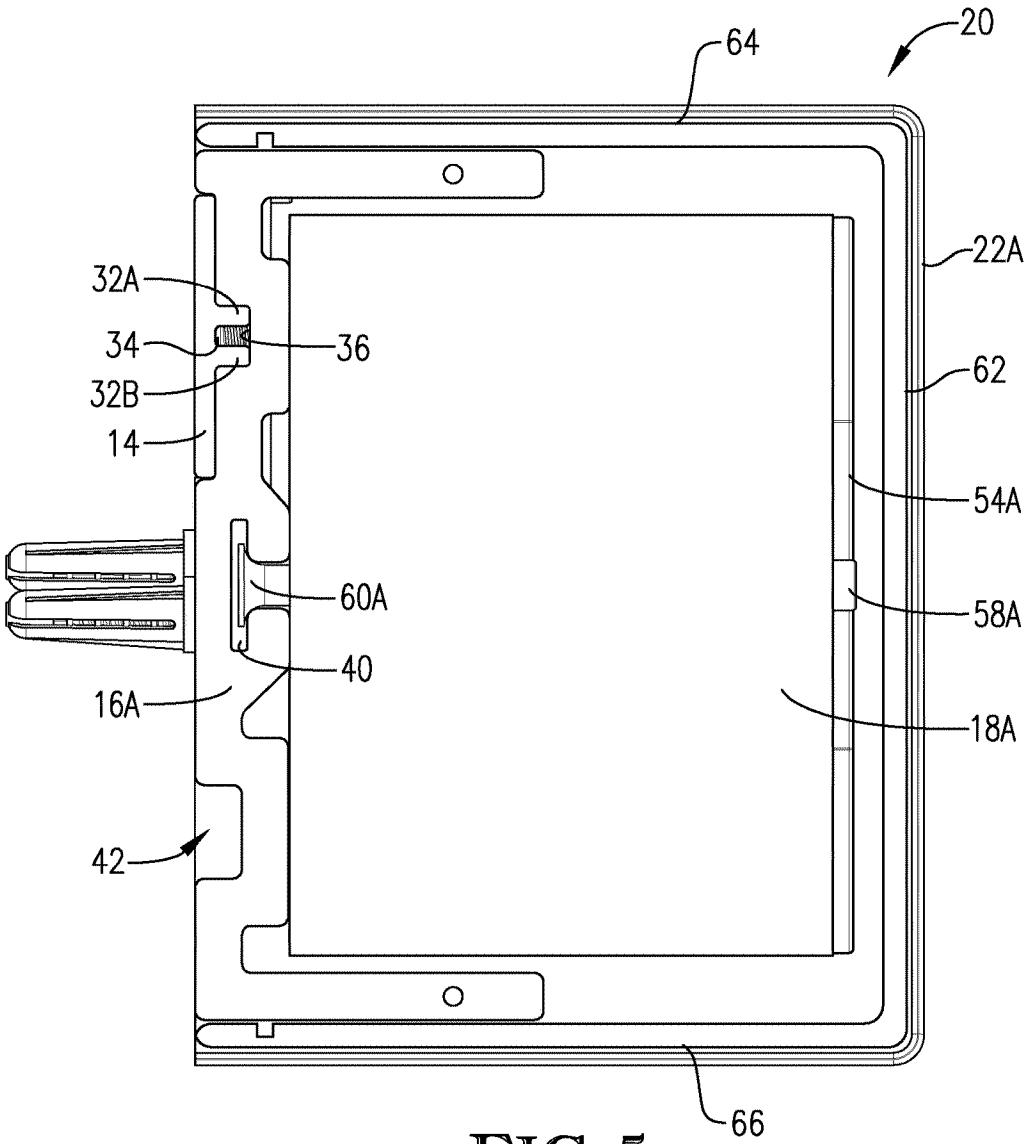
FIG. 5 is a side elevation view of the variable length soundbar of FIG. 1.
Figure 7:
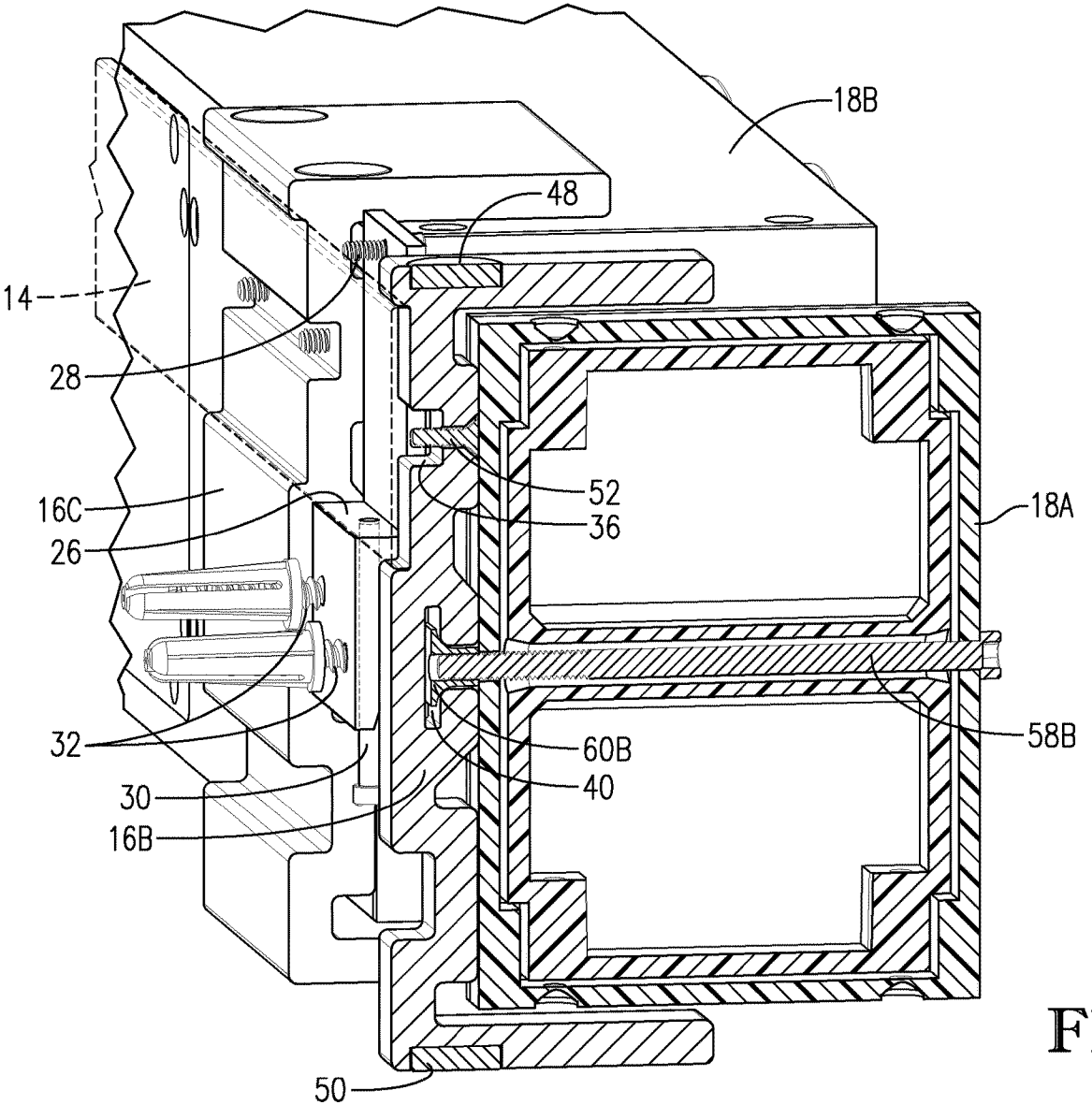
FIG. 7 is a perspective cutaway view of certain components of the variable length soundbar of FIG. 1.
Figure 8:
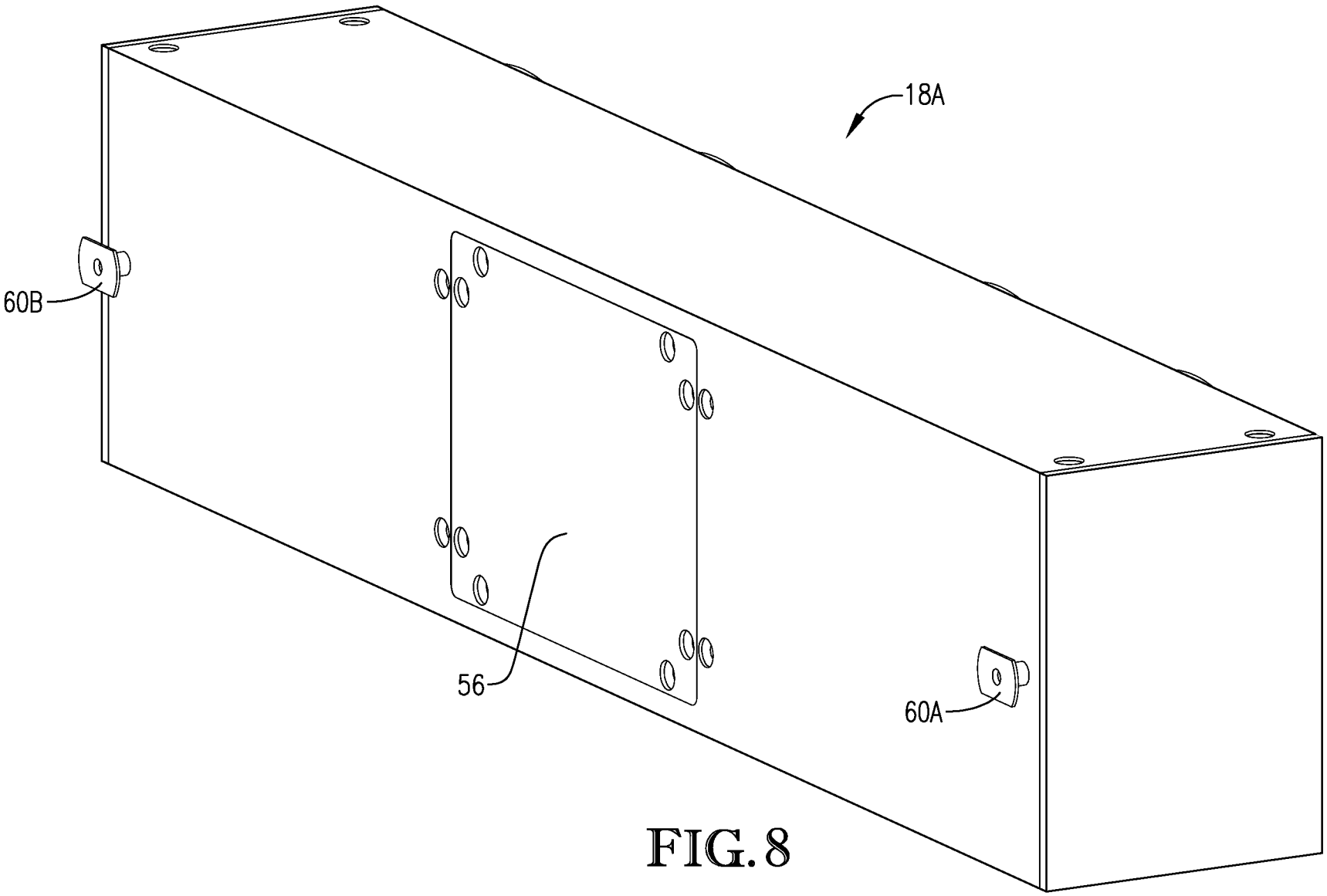
FIG. 8 is a rear perspective view of the variable length soundbar of FIG. 1.

The speaker mounting brackets 16A-F are substantially similar so only speaker mounting bracket 16A will be described in detail. The speaker mounting bracket 16A includes an alignment bar recess 34, an alignment bar fastener aperture 38, a T-slot 40, a wire guide 42, a plurality of upper magnet recesses 44, a plurality of lower magnet recesses 46, a plurality of upper grille retention magnets 48, and a plurality of lower grille retention magnets 50, as best shown in FIGS. 5-7. The speaker mounting brackets 16A-F are configured to be laterally spaced from each other along the alignment bar 14.

The alignment bar recess 34 may include geometry corresponding to a shape of the alignment bar 14 for orienting the speaker mounting bracket 16A on the alignment bar 14. The alignment bar recess 34 also allows the speaker mounting bracket 16A to be laterally slid along the alignment bar 14 for ease of assembly.

The alignment bar fastener aperture 38 receives a fastener 52 therethrough for securing the speaker mounting bracket 16A to the alignment bar 14. The alignment bar fastener aperture 38 may be vertically centered in the alignment bar recess 34.

The T-slot 40 may be an open-ended groove configured to receive a T-shaped nut and a speaker fastener (described below) therein for anchoring the speaker 18A thereto. The T-slot 40 may be positioned approximately vertically midway to align with a fastener slot of the speaker 18A.

The wire guide 42 may be a laterally open slot configured to receive audio and/or power wires therein. The wire guide 42 allows the audio and/or power wires to be retained and organized behind the speaker mounting bracket 16A.

The upper magnet recesses 44 retain the upper grille retention magnets 48 in an upper portion of the speaker mounting bracket 16A. The upper magnet recesses 44 may be spaced apart from each other near opposite sides of the speaker mounting bracket 16A so that the upper grille retention magnets 48 more effectively magnetically engage the grille 20.

The lower magnet recesses 46 retain the lower grille retention magnets 50 in a lower portion of the speaker mounting bracket 16A. The lower magnet recesses 46 may be spaced apart from each other near opposite sides of the speaker mounting bracket 16A so that the lower grille retention magnets 48 more effectively magnetically engage the grille 20.

The upper grille retention magnets 48 magnetically attract an upper portion of the grille 20 so as to retain the grille 20 over the speakers 18A-C. The upper grille retention magnets 48 may be positioned in recesses in an upper surface of the speaker mounting bracket 16A.

The lower grille retention magnets 50 magnetically attract a lower portion of the grille 20 so as to retain the grille 20 over the speakers 18A-C. The lower grille retention magnets 50 may be positioned in recesses in a lower surface of the speaker mounting bracket 16A.

Figure 3:
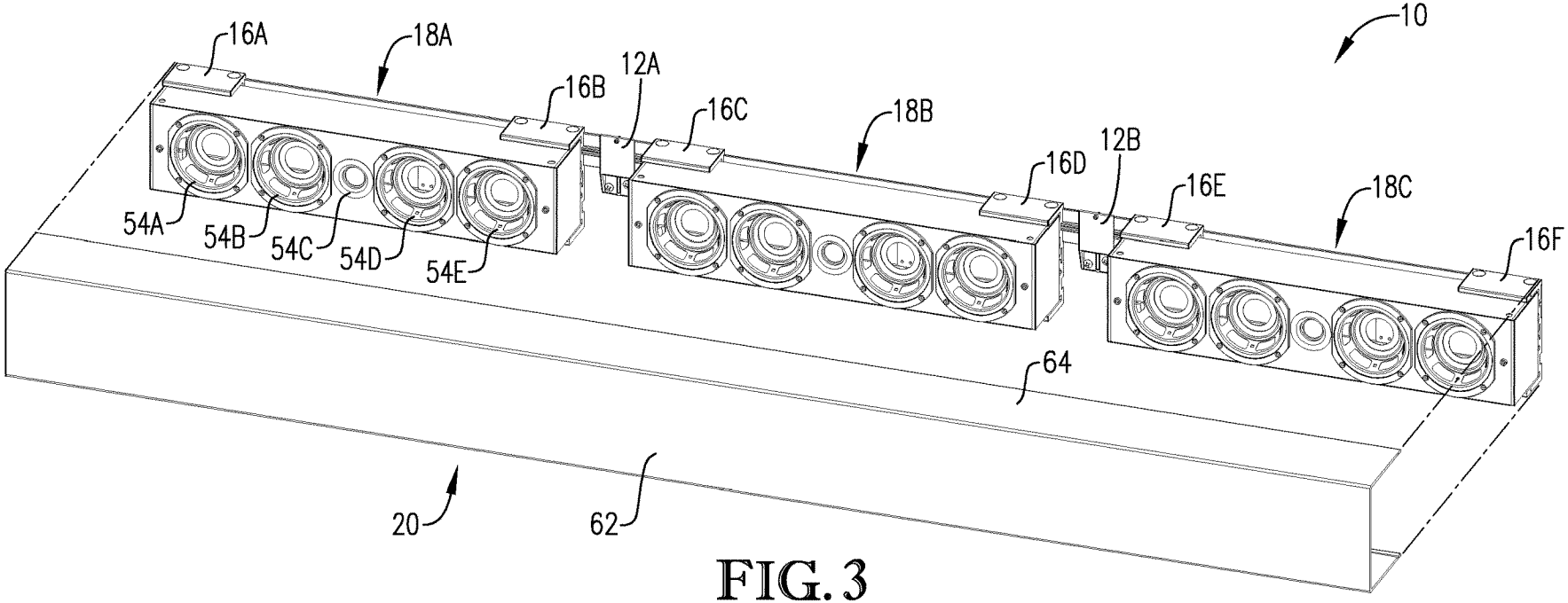
FIG. 3 is another front perspective view of the variable length soundbar of FIG. 1.
Figure 4:
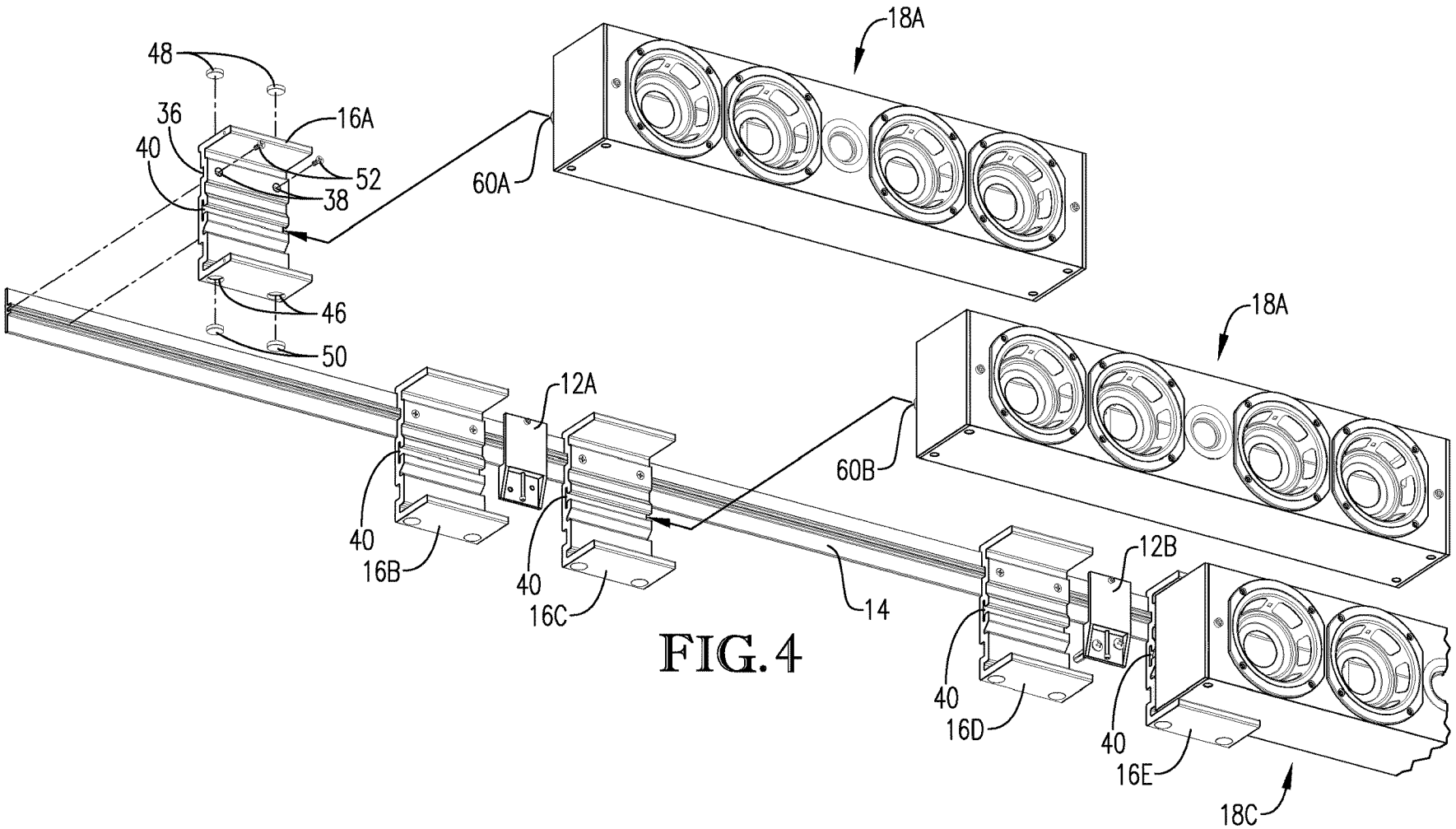
FIG. 4 is an exploded view of the variable length soundbar of FIG. 1.
Figure 10:
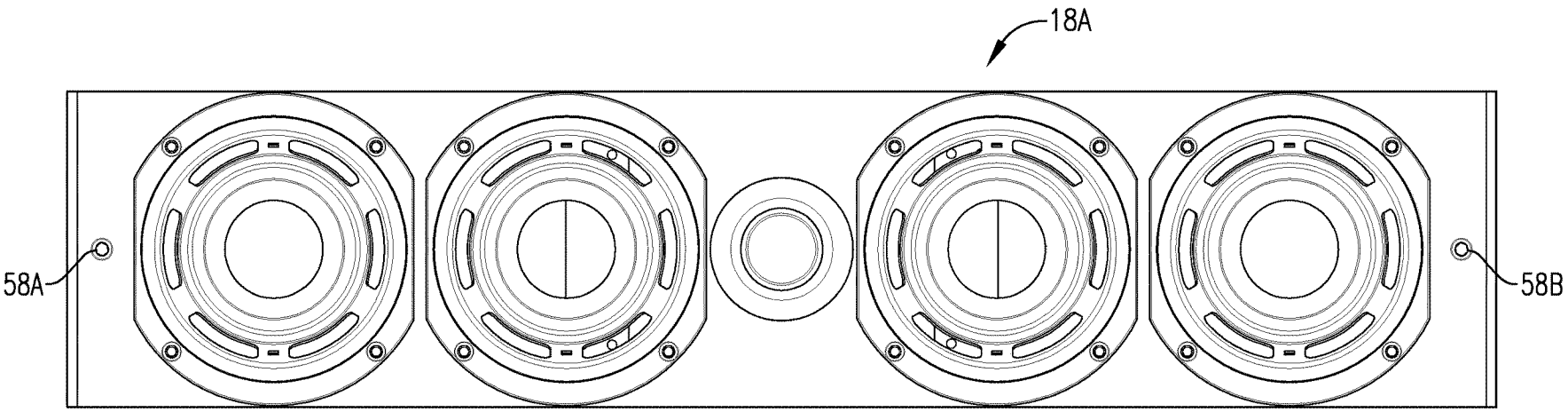
FIG. 10 is a front elevation view of a speaker of the variable length soundbar of FIG. 1.
Figure 11:
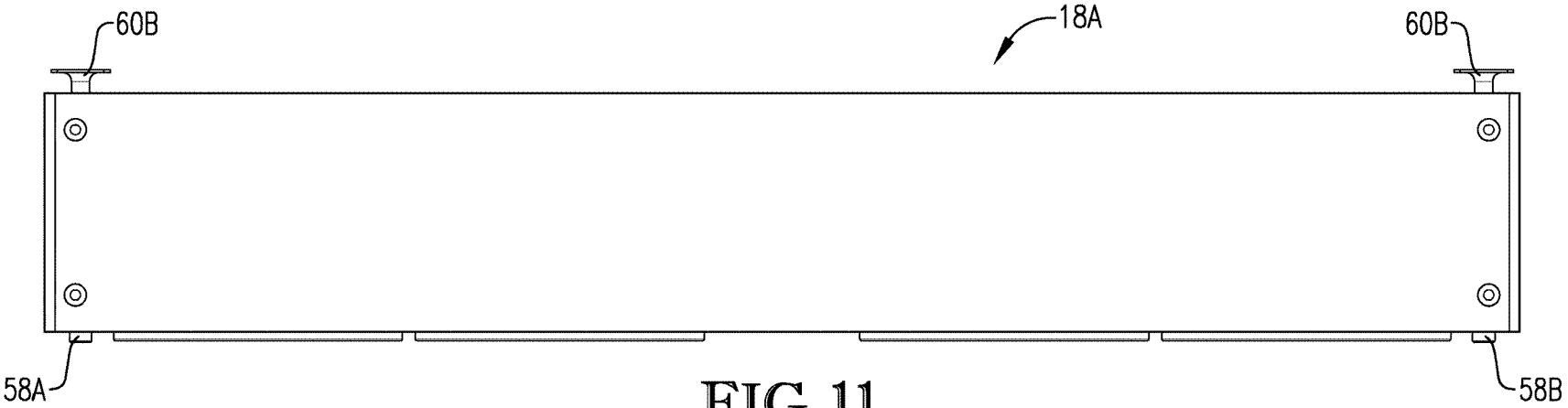
FIG. 11 is a top plan view of the speaker of FIG. 10.

The speakers 18A-C provide audio output and are substantially similar so only speaker 18A will be described in detail. The speaker 18A includes one or more drivers 54A-E, a backplate 56, left and right fasteners 58A,B, and left and right T-nuts 60A,B, as best shown in FIGS. 3, 10, and 11.

Each driver 54A-E may be a low frequency range driver, a mid-frequency range driver, a high frequency range driver, and/or a combination thereof (e.g., a low and mid frequency range driver). The drivers 54A-E may be arranged in a horizontally symmetric row or any other pattern and are at least partially positioned in a driver chamber of the speaker 18A.

The backplate 56 encloses and provides access to the driver chamber of the speaker 18A and lays flush with a back wall of the speaker 18A. The backplate 56 may include fastener holes for securing the backplate 56 in place.

The left and right fasteners 58A,B may be elongated bolts that extend through through-holes in the speaker 18A and may include helical threads for engaging the left and right T-nuts 60A,B. The left and right fasteners 58A,B thereby secure the speaker 18A to the speaker mounting bracket 16A.

The left and right T-nuts 60A,B may be flanged nuts having a central aperture with helical threads for engaging the left and right fasteners 58A,B. To that end, the left and right T-nuts 60A,B are positioned in the T-slot 40 of the speaker mounting bracket 16A with their central apertures aligned with the through-holes of the speaker 18A.

The grille 20 may be a laterally elongated rigid cover having a front portion 62, an upper portion 64, and a lower portion 66. The front portion 62 conceals the drivers 54A-E of the speakers 18A-C. The upper portion 64 extends over the speakers 18A-C from a top of the front portion 62 and magnetically engages the upper grille retention magnets 48. The lower portion 66 extends under the speakers 18A-C from a bottom of the front portion 62 and magnetically engages the lower grille retention magnets 50. To that end, the grille 20 may be metal or may be a plastic material embedded with ferrous metal for engaging the upper and lower grille retention magnets 48, 50. The grille 20 may have any desired length (e.g., cut-to-length) corresponding to the desired length of the variable length soundbar 10.

The left and right end caps 22A,B bookend the grille 20 to provide a finished appearance. To that end, the left and right end caps 22A,B may be friction-fit onto left and right ends of the grille 20 or attached to the grille 20 or outer speakers 18A,C via fasteners.

Use of the variable length soundbar 10 will now be described in detail. First, the speakers 18A-C are positioned in the speaker mounting brackets 16A-F such that each speaker 18A-C is received in two speaker mounting brackets. For example, speaker 18A is positioned in speaker mounting brackets 16A,B. The left and right T-nuts 60A,B are positioned in the T-slot 40. The left and right fasteners 58A,B are rotated in the through-holes of the speaker 18A so as to draw the left and right T-nuts 60A,B and hence the speaker 18A against the speaker mounting bracket 16A.

The alignment bar 14 may then be resized to a desired length. For example, the alignment bar 14 may be cut to a length equal to a width of a television to which the variable length soundbar 10 is to be paired. Alternatively, the alignment bar 14 may be telescoping. The grille 20 may be cut to an equivalent length.

The speaker mounting brackets 16A-F may then be positioned on the alignment bar 14 with the alignment bar 14 being received in the alignment bar recess 34 of each speaker mounting bracket 16A-F. Fasteners 52 may then be inserted through the alignment bar fastener apertures 38 of the speaker mounting brackets 16A-F into the extended speaker bracket attachment geometry 36 of the alignment bar 14 so as to engage the alignment bar 14.

Speaker mounting brackets paired together, such as speaker mounting brackets 16A,B may be spaced from each other so they are flush with left and right sides of the speaker 18A. Speaker mounting brackets of adjacent pairs, such as speaker mounting brackets 16B,C may also be spaced from each other so that the corresponding speakers (e.g., speakers 18A,B) are spaced from each other a desired distance.

The alignment bar 14 may then be positioned on the alignment bar ledge 26 on the vertical screw leveler 30 of each of the leveling brackets 12A,B. The leveling brackets 12A,B may be spaced from each other so as to fit between adjacent speakers 18A,B and 18B,C. The stop screw 28 may then be drawn into the alignment bar ledge 26 over the alignment bar 14 to prevent the alignment bar 14 from lifting off the alignment bar ledge 26.

The leveling brackets 12A,B may then be secured to a wall or other vertical structure via fasteners 32 inserted through the wall fastener apertures 24 of the leveling brackets 12A,B. The leveling brackets 12A,B should be nominally level with each other.

The grille 20 may then be placed over the speakers 18A-C such that the speakers 18A-C are concealed. To that end, the upper grille retention magnets 48 secure the upper portion 64 of the grille 20 and the lower grille retention magnets 50 secure the lower portion 66 of the grille 20. The grille 20 may be truncated or reduced in length so that the grille 20 is flush with outer sides of outer speaker mounting brackets 16A,F and/or outer speakers 14A,C.

The alignment bar 12 and hence the speakers 18A-C may then be fully leveled via the vertical screw leveler 30 of each leveling bracket 12A,B if necessary. To that point, the variable length soundbar 10 may be snug against the TV or projector screen or spaced below the TV or projector screen as desired. This may require removing the grille 20 to adjust the vertical screw leveler 30 (of one or both of the leveling brackets 12A,B) then installing the grille 20 to check levelness.

The left and right end caps 22A,B may then be secured onto ends of the grille 20. This results in the variable length soundbar 10 appearing to be a single solid unit.

The above steps are listed in an exemplary order only. Some steps may be performed in a different order and/or simultaneously.

The variable length soundbar 10 provides several advantages. For example, the speakers 18A-C can be spaced from each other as desired with minimal tooling and no electronics knowledge. This allows for fine-tuning acoustics for any room or entertainment area. The variable length soundbar 10 can be any desired length instead of one of a few pre-set lengths. This allows the variable length soundbar 10 to match widths of virtually any television or entertainment device. The variable length soundbar 10 may use virtually any ratio of speakers to soundbar length. For example, one speaker may be used every 18 inches. One speaker may be used for less than 18 inches for more output, while one speaker may be used for more than 18 inches for less output. The grille 20 allows the variable length soundbar 10 to appear seamless and uniform while maintaining a custom length.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A variable length soundbar comprising:

a plurality of leveling brackets configured to be laterally spaced from each other for providing vertical leveling;

a plurality of speaker mounting brackets configured to be laterally spaced from each other;

an elongated alignment bar extending between the plurality of leveling brackets and the plurality of speaker mounting brackets;

a plurality of speakers configured to be laterally spaced from each other and mounted on the plurality of speaker mounting brackets; and a grille configured to at least partially cover the plurality of speakers, the grille and elongated alignment bar being configured to be resized to a desired length.

2. The variable length soundbar of claim 1, the elongated alignment bar including extended attachment geometry configured such that each of the plurality of speaker mounting brackets can be attached to the elongated bar at one of a continuous plurality of points on the elongated alignment bar.

3. The variable length soundbar of claim 1, each of the plurality of leveling brackets including a vertical screw leveler.

4. The variable length soundbar of claim 1, each of the plurality of speaker mounting brackets including an alignment bar slot configured to receive the alignment bar therein.

5. The variable length soundbar of claim 1, each of the plurality of speakers including a plurality of T-shaped fasteners, each of the plurality of speaker mounting brackets including a T-slot configured to receive one of the plurality of T-shaped fasteners therein.

6. The variable length soundbar of claim 1, each of the plurality of speaker mounting brackets including upper grille retention magnets and a plurality of lower grille retention magnets configured to retain the grille over the plurality of speakers.

7. The variable length soundbar of claim 1, each of the plurality of speakers including a plurality of drivers configured to output sounds of a plurality of frequencies.

8. The variable length soundbar of claim 1, further comprising left and right end caps configured to bookend the grille.

9. The variable length soundbar of claim 1, wherein the elongated alignment bar and the grille are configured to be cut to the desired length.

10. The variable length soundbar of claim 1, each of the plurality of speaker mounting brackets including a speaker wire groove.

11. A variable length soundbar comprising:

a plurality of leveling brackets each including a plurality of wall fastener apertures for attaching the leveling bracket to a wall;

an elongated alignment bar configured to extend between the plurality of leveling brackets;

a plurality of speaker mounting brackets configured to be laterally spaced from each other, each speaker mounting bracket comprising an alignment bar slot configured to receive the elongated alignment bar and an alignment bar fastener aperture configured to retain the speaker mounting bracket on the elongated alignment bar and to retain the elongated alignment bar in the alignment bar slot;

a plurality of speakers configured to be spaced from each other and mounted on the plurality of speaker mounting brackets; and a grille configured to at least partially cover the plurality of speakers, the grille and the elongated alignment bar being configured to be resized to a desired length.

12. The variable length soundbar of claim 11, the elongated alignment bar including extended attachment geometry configured such that each of the plurality of speaker mounting brackets can be attached to the elongated alignment bar at one of a continuous plurality of points on the elongated alignment bar.

13. The variable length soundbar of claim 11, each of the plurality of leveling brackets including a vertical screw leveler.

14. The variable length soundbar of claim 11, each of the plurality of speakers including a plurality of T-nuts, each of the plurality of speaker mounting brackets including a T-slot configured to receive one of the plurality of T-nuts therein.

15. The variable length soundbar of claim 11, each of the plurality of speaker mounting brackets including upper grille retention magnets and a plurality of lower grille retention magnets configured to retain the grille over the plurality of speakers.

16. The variable length soundbar of claim 11, each of the plurality of speakers including a plurality of drivers configured to output sounds of a plurality of frequencies.

17. The variable length soundbar of claim 11, further comprising left and right end caps configured to bookend the grille.

18. The variable length soundbar of claim 11, wherein the elongated alignment bar and the grille are configured to be cut to the desired length.

19. A variable length soundbar comprising:

a plurality of leveling brackets each comprising:

a plurality of wall fastener apertures for attaching the leveling bracket to a wall; and a vertical screw leveler for providing vertical leveling;

an elongated alignment bar configured to extend between the plurality of leveling brackets and be leveled by the vertical screw leveler of each of the plurality of leveling brackets, the elongated alignment bar including extended attachment geometry;

a plurality of speaker mounting brackets configured to be laterally spaced from each other, each speaker mounting bracket comprising:

an alignment bar slot configured to receive the elongated alignment bar;

an alignment bar fastener aperture configured to retain the speaker mounting bracket on the elongated alignment bar and to retain the elongated alignment bar in the alignment bar slot;

a T-slot configured to receive a speaker fastener therein;

a plurality of upper grille retention magnets on an upper side of the speaker mounting bracket;

a plurality of lower grille retention magnets on a lower side of the speaker mounting bracket; and a speaker wire groove configured to receive a speaker wire therein, the extended attachment geometry of the elongated alignment bar being configured such that each of the plurality of speaker mounting brackets can be attached to the elongated alignment bar at one of a continuous plurality of points on the elongated alignment bar;

a plurality of speakers configured to be spaced from each other, each speaker comprising:

a plurality of drivers configured to output sounds of a plurality of frequencies; and left and right T-shaped fasteners configured to be received in the T-slot of one of the speaker mounting brackets;

a grille configured to be positioned and magnetically retained over the plurality of speakers via the upper and lower grille retention magnets, the grille and the elongated alignment bar being configured to be cut to a desired length; and left and right end caps configured to bookend the grille.

* * * * *